US006672890B1

(12) United States Patent
Witherspoon

(10) Patent No.: US 6,672,890 B1
(45) Date of Patent: Jan. 6, 2004

(54) ELECTRICAL ADAPTER

(76) Inventor: Heath P. Witherspoon, 461 Edgehill Drive, Barrie, Ontario (CA), L4M 4S4

( * ) Notice: Subject to any disclaimer, the term of this patent is extended or adjusted under 35 U.S.C. 154(b) by 52 days.

(21) Appl. No.: 10/156,046

(22) Filed: May 28, 2002

(51) Int. Cl.[7] ..... H01R 25/00
(52) U.S. Cl. ..... 439/220
(58) Field of Search ..... 439/170, 171, 439/172, 173, 217, 222, 175, 221, 218; 363/146; 336/92, 192, 198

(56) References Cited

U.S. PATENT DOCUMENTS 2,644,128 A * 6/1953 Henrich et al. ..... 323/247
4,107,636 A * 8/1978 DiGirolamo ..... 336/92
4,419,569 A * 12/1983 Colten ..... 219/528
5,159,545 A * 10/1992 Lee ..... 363/146
5,563,782 A * 10/1996 Chen et al. ..... 363/146
5,613,863 A * 3/1997 Klaus et al. ..... 439/131
5,648,712 A * 7/1997 Hahn ..... 320/111

* cited by examiner

*Primary Examiner*—Jean F. Duverne

(57) ABSTRACT

An electrical adapter connects a plug to a socket of an higher voltage. The adapter has a housing, prongs, a breaker, a first group of wires, a receptacle, and a second group of wires. The housing has two faces joined by four sides. The prongs extend from a front face toward the socket. A breaker, between the faces, connects to the prongs individually by the first group of wires. A receptacle, opposite the breaker, has holes for the plug. The second group of wires connects the holes separately to the breaker with one less hot wire than the first group.

9 Claims, 4 Drawing Sheets

ELECTRICAL ADAPTER

BACKGROUND OF THE INVENTION

1. Field of the Invention

The present invention relates to an Electrical Adapter for use in connection with residential appliances and tools. Typical dwellings have electrical service for appliances and tools near 220-volts. Upon converting to natural gas operated appliances, a power supply of at least 110-volts is required for their operation. Avoiding a separate lower voltage circuit, the present invention inserts into an existing nearly 220-volt socket and lowers the voltage to nearly 110-volts. The present invention connects two hot wires to the breaker from the socket but has only one hot wire between the socket and the receptacle. The Electrical Adapter has particular utility with connecting residential appliances and tools to sockets of higher voltage.

2. Description of the Prior Art

Electrical Adapters are desirable to step down a socket's voltage to that required by an appliance or tool. Typical dwellings have electrical service for appliances and tools. Ranges, stoves, ovens, and dryers operate on a power supply of at least 220-volts. Upon converting to natural gas operated appliances or using light construction tools, a power supply of at least 110-volts is required for their operation. A voltage step down requires a separate lower voltage circuit or a transformer.

The use of transformers is known in the prior art. For example, U.S. Pat. No. 6,108,226 to Ghosh, et. al discloses a transformer and method to detect line conditions. However, the Ghosh '226 patent does not have a circuit breaker and does not reduce the number of wires, and has further drawbacks of energy loss during transforming and of complexity in the processor.

U.S. Pat. No. 5,159,545 to Lee discloses an adapter that has multiple plug sets for different national power supplies. However, the Lee '545 patent does not have fixed prongs, does not reduce the number of wires, and additionally does not have a side mounted receptacle.

Similarly, U.S. Pat. No. 5,589,760 to Lee discloses a voltage converter that automatically switches between output wattages. However, the Lee '760 patent does not does not reduce the number of wires, and cannot reduce the energy lost during transforming.

Similarly, U.S. Pat. No. 2,644,128 to Henrich discloses a regulator that changes the phase of an auxiliary voltage. However, the Henrich '128 patent does require two transformers, and cannot have a side-mounted receptacle.

Similarly, U.S. Pat. No. 4,107,636 to DiGirolamo discloses a plug-in adaptor that lowers voltage with an encased transformer. However, the DiGirolamo '636 patent does not connect with three prong sockets common in 220-volt circuits, and cannot reduce the number of wires between the socket and the secondary line.

Lastly, U.S. Pat. No. Des. 412,699 to Lee discloses an adapter that has a side receptacle. However, the Lee '699 patent does not have prongs, and has the additional deficiency of the receptacle extending well beyond the side.

While the above-described devices fulfill their respective, particular objectives and requirements, the aforementioned patents do not describe an electrical adapter that allows connecting residential appliances and tools to sockets of higher voltage. The Ghosh '226 patent makes no provision for a circuit breaker. The Lee '545 patent lacks a side-mounted receptacle. The Lee '760 patent makes no provision for reducing the number of wires. The Henrich '128 patent makes no provision for omitting a wire to lower the voltage. The DiGirolamo '636 patent and the Lee '699 patent lack prongs to connect with 220-volt circuits.

Therefore, a need exists for a new and improved Electrical Adapter that can be used for connecting residential appliances and tools to sockets of higher voltage. In this regard, the present invention substantially fulfills this need. In this respect, the Electrical Adapter according to the present invention substantially departs from the conventional concepts and designs of the prior art, and in doing so provides an apparatus primarily developed for the purpose of connecting residential appliances and tools to sockets of higher voltage.

SUMMARY OF THE INVENTION

In view of the foregoing disadvantages inherent in the known types of transformers now present in the prior art, the present invention provides an improved Electrical Adapter, and overcomes the above-mentioned disadvantages and drawbacks of the prior art. As such, the general purpose of the present invention, which will be described subsequently in greater detail, is to provide a new and improved Electrical Adapter and method which has all the advantages of the prior art mentioned heretofore and many novel features that result in a Electrical Adapter which is not anticipated, rendered obvious, suggested, or even implied by the prior art, either alone or in any combination thereof.

To attain this, the present invention essentially comprises an electrical adapter that connects a plug of a device of a lower voltage to a socket of an higher voltage. The adapter has a housing, prongs, a breaker, a first group of wires, a receptacle, and a second group of wires. The housing has a front face parallel to the socket, a rear face opposite the front face, a first side substantially perpendicular to said front face, a second side opposite said first side, a third side substantially perpendicular to said first side, and a fourth side opposite said third side. The first, second, third, and fourth sides form a rectangle that joins the perimeter of the front and rear faces. The prongs, in a group of three or more, extend out from the front face and align with the socket. The prongs include a first prong with a round cross-section in a plane parallel to the front face. A breaker is located between the front face and the rear face substantially near and parallel to the third side. The breaker has a button that extends through the second side. A first group of wires connects each of the prongs individually to the breaker. A receptacle is located between the front face and the rear face, opposite the breaker, substantially near and parallel to the fourth side. The receptacle extends through the second side and has holes to receive the plug of the device. A second group of wires connects the holes in the receptacle individually to the breaker. The second group of wires has one less hot wire than the first group of wires thus, lowering the voltage at the receptacle.

There has thus been outlined, rather broadly, the more important features of the invention in order that the detailed description thereof that follows may be better understood and in order that the present contribution to the art may be better appreciated.

The invention may also include a concave front face to mount the invention easily upon a socket, an electrically inert housing like poly-vinyl-chloride, rectangular prongs, and a polarized receptacle. The breaker remains in series with the one hot wire to the receptacle with a rating of one or more amperes. There are, of course, additional features of the invention that will be described hereinafter and which will form the subject matter of the claims attached.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and the scope of the present invention.

It is therefore an object of the present invention to provide a new and improved Electrical Adapter that has all of the advantages of the prior art transformers and none of the disadvantages.

It is another object of the present invention to provide a new and improved Electrical Adapter that may be easily and efficiently manufactured and marketed.

An even further object of the present invention is to provide a new and improved Electrical Adapter that has a low cost of manufacture with regard to both materials and labor, and which accordingly is then susceptible of low prices of sale to the consuming public, thereby making such Electrical Adapter economically available to the buying public.

Still another object of the present invention is to provide a new Electrical Adapter that provides in the apparatuses and methods of the prior art some of the advantages thereof, while simultaneously overcoming some of the disadvantages normally associated therewith.

Even still another object of the present invention is to provide a Electrical Adapter for connecting residential appliances and tools to sockets of higher voltage. This allows electricity at a lower voltage without an additional circuit or transformer.

Still yet another object of the present invention is to provide a Electrical Adapter for connecting residential appliances and tools to sockets of higher voltage. This makes it possible to mount the invention close to a wall.

Still yet another object of the present invention is to provide a Electrical Adapter for connecting residential appliances and tools to sockets of higher voltage. This makes it possible to power light construction tools.

Lastly, it is an object of the present invention to provide a new and improved method for lowering the voltage between a socket and a receptacle. The method involves, connecting the prongs to a breaker by individual wires, connecting the holes of a receptacle to the breaker by individual wires where one less hot wire than those provided by the prongs reaches the receptacle and the breaker is in series with the hot wire to the receptacle, inserting the prongs into the socket, and inserting a plug of a device into the receptacle.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DESCRIPTION OF THE PREFERRED EMBODIMENT

Figure 1:
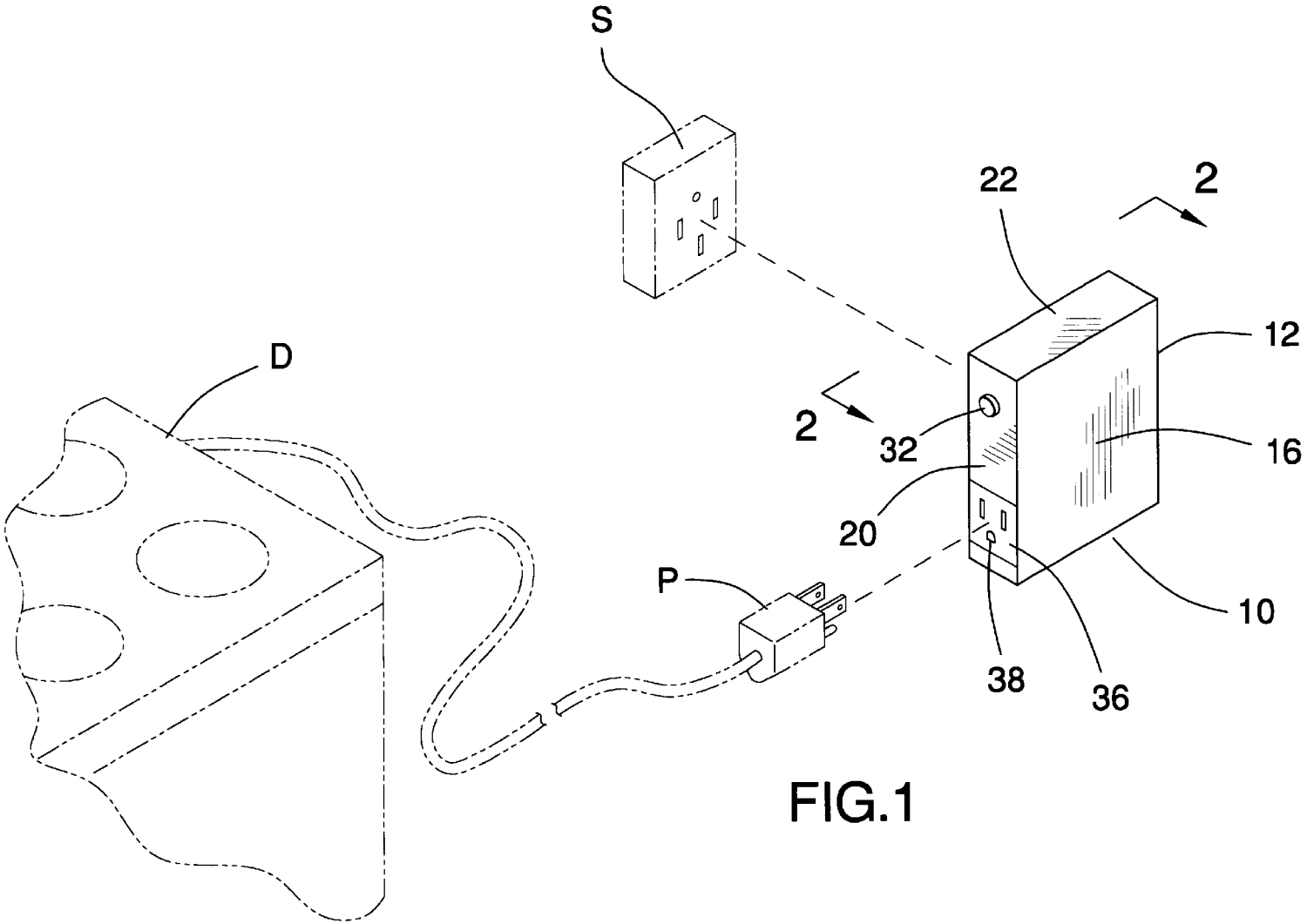
FIG. 1 is an oblique perspective view of the preferred embodiment of the Electrical Adapter constructed in accordance with the principles of the present invention and of the Electrical Adapter connecting to a device and a socket.

Referring now to the drawings, and particularly to FIGS. 1–4, a preferred embodiment of the electrical adapter of the present invention is shown and generally designated by the reference numeral 10.

In FIG. 1, a new and improved electrical adapter 10 of the present invention for connecting devices D to sockets S of higher voltage is illustrated and will be described. Typical dwellings have electrical service for devices D at 220-volts. Upon converting to natural gas operated devices D, a power supply of at least 110-volts is required for their operation. The devices D could be a range, stove, oven, or dryer. In an alternate embodiment, the device D could be a light construction tool such as a drill. Avoiding a separate lower voltage circuit or a transformer, the electrical adapter 10 inserts into an existing 220-volt socket S and lowers the voltage to generally 110-volts. More particularly, the electrical adapter 10 has a housing 12 made of an electrically inert material such as poly-vinyl-chloride. The housing 12 has a front face 14, a rear face 16, a first side 18, a second side 20, a third side 22, and a fourth side 24. The housing 12 has a general rectangular shape with the sides arranged in a rectangle, joining the perimeters of the front face 14 and rear face 16. In this view, the rear face 16 of the housing 12 is shown the farthest away from the socket S, the second side 20 of the housing 12 appears opposite the plug P of the device D, and the third side 22 appears substantially perpendicular to the second side 20. The plug P is a typical 110-volt male connector with two parallel blades and a ground. The rear face 16 and first side 18 are flat. The second side 20 has openings to admit a button 32 from the breaker 30 and the receptacle 36. The receptacle 36 is a typical 110-volt female connector with three holes 38 including a ground. The holes 38 of the receptacle 36 match the blades and ground of the plug P. In an alternate embodiment, the receptacle 36 is polarized with one hole 38 slightly longer than the other hole 38.

Figure 2:
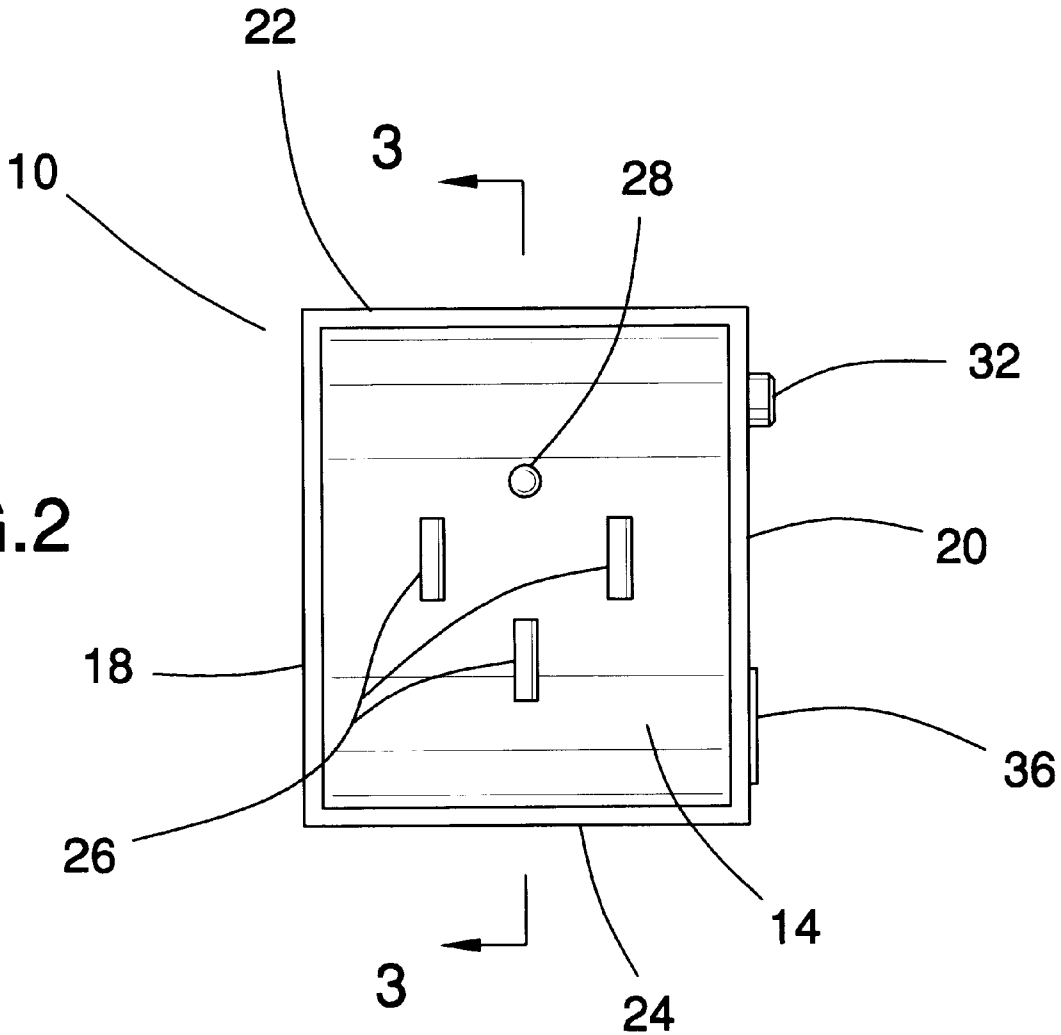
FIG. 2 is an elevation view of the front face of the Electrical Adapter of the present invention.

FIG. 2 illustrates the electrical adapter 10 viewed from the front face 14. Substantially in the center of the front face 14, the plurality of prongs 26 extends substantially perpendicular from the plane of the front face 14. The plurality of prongs 26 has three or more prongs including a first prong 28 with a round cross section on a plane parallel to the front face 14. Located the closest to the third side 22 of the prongs, the first prong 28 functions as the ground. The remaining prongs have an orientation that matches the socket S, hence the prongs 26 register with the socket S. In the preferred embodiment, the remaining prongs 26 parallel each other with the longer dimension of the prongs' 26 cross-section parallel to the second side 20. In an alternative embodiment, the prong 26 closest to the fourth side 20 can be rotated for alternate socket S openings.

Behind the plurality of prongs 26 lies the front face 14. Nearest to the first prong 28, the third side 22 joins the front face 14 to the rear face 16. Adjoining an end of the third side 22, the second side 20 extends substantially perpendicular to the third side 22 and has openings to admit the button 32 of the breaker 30 and the receptacle 36. Adjoining the other end of the third side 22, the first side 18 extends substantially perpendicular to the third side 20. The fourth side 24 completes the perimeter of the housing 12 by connecting the ends of the first side 18 and second side 20. The first, second, third, and fourth sides 18, 20, 22, 24 form a substantially rectangular shape that joins the front face 14 and the rear face 18. On the second side 20, the opening for the breaker 30 button 32 is closer to the first prong 28 and the third side 22. The opening for the receptacle 36 is farther from the first prong 28 and closer to the fourth side 24.

Figure 3:
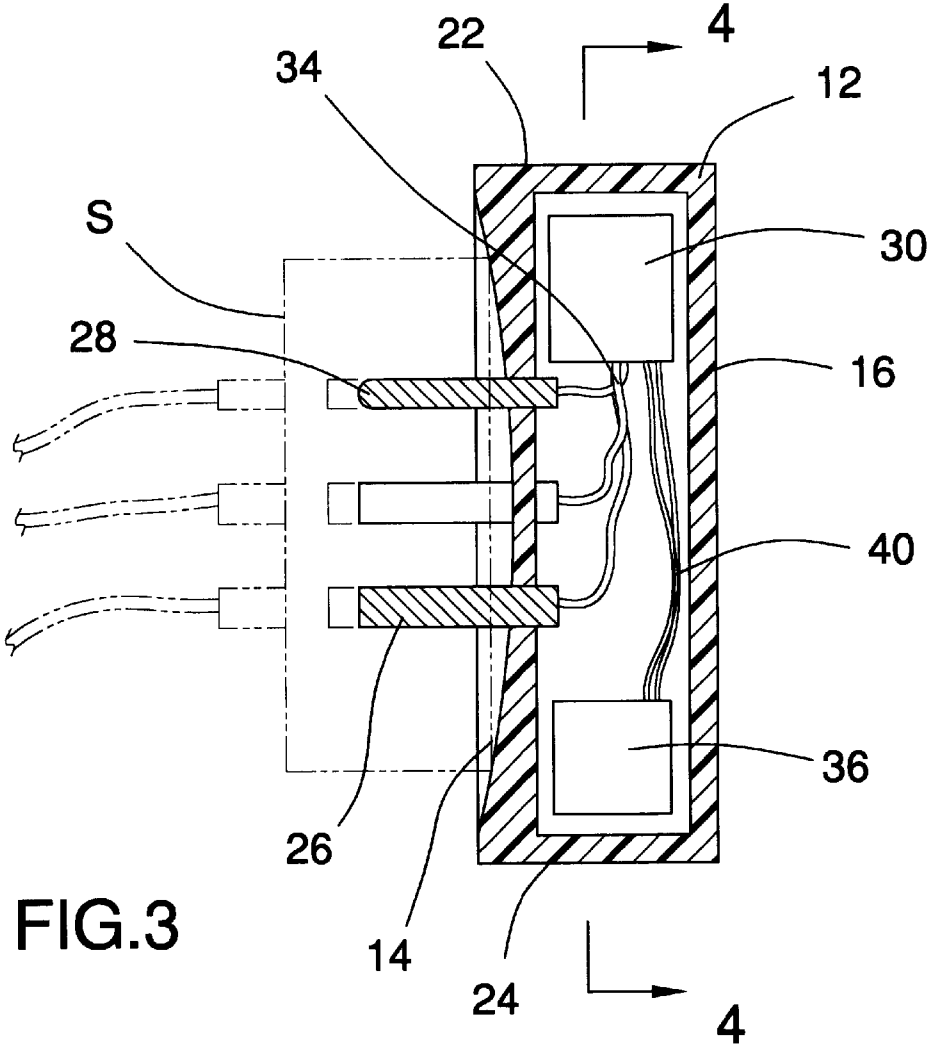
FIG. 3 is a section view on a plane parallel to the first side of the Electrical Adapter of the present invention installed in a socket.

With the electrical adapter 10 in use, FIG. 3 shows the plurality of prongs 26 inserted into the socket S. This view takes a section through the front face 14, the rear face 16, the third side 22, and the fourth side 20. The prongs 26 connect separately by the first plurality of wires 34 to the breaker 30. The breaker 30 is nearer to the first prong 28 and the third side 22. Having one less hot wire than the first plurality of wires 34, the second plurality of wires 40 connects the breaker 30 to the holes 38 of the receptacle 36 separately. A hot wire carries current provided from a power supply, between the socket S, the breaker 30, and the receptacle 36. The present invention connects two hot wires to the breaker 30 from the socket S as in typical 220-volt wiring but has only one hot wire between the socket S and the receptacle 36 as in typical 110-volt wiring. The breaker 30 functions as a safety device D and will open the circuit upon detecting a certain amperage of current. The receptacle 36 is further from the first prong 28 and closer to the fourth side 20. In the preferred embodiment, the front face 14 is flat. FIG. 3 has an alternate embodiment of the front face 14 as concave. A concave front face 14 permits a snug installation of the electrical adapter 10 upon a socket S. The concavity runs from substantially near the third side 22 to substantially near the fourth side 24 attaining maximum concavity at the center of the front face 14 near the plurality of prongs 26. Further, the concavity extends from substantially near the first side 18 to substantially near the second side 20.

Figure 4:
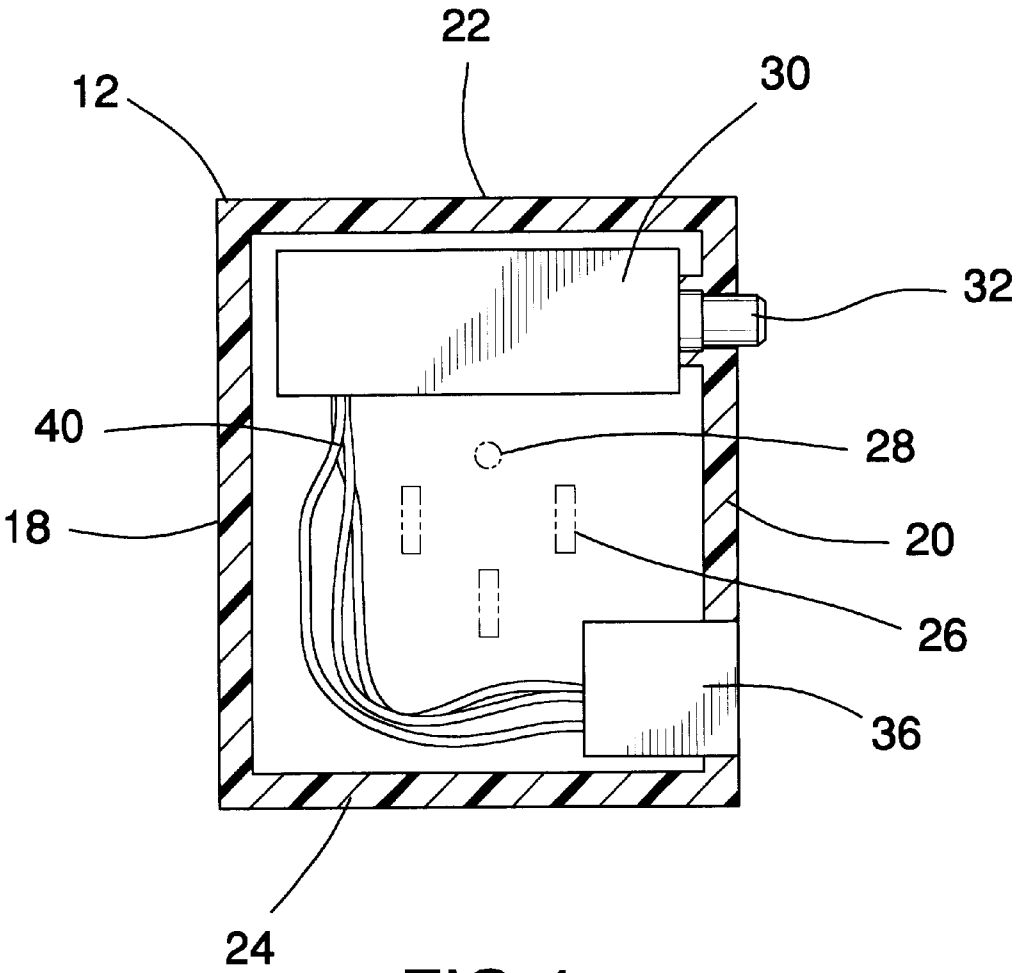
FIG. 4 is a section view on a plane parallel to the rear face of the Electrical Adapter of the present invention.

Turning to FIG. 4, this view takes a section through the first side 18, the second side 20, the third side 22, and the fourth side 24. The breaker 30 is located between the first prong 28 and the third side 22, and parallels the third side 22. The breaker 30 has a button 32 that extends through the second side 20. The second plurality of wires 40 pass around the plurality of prongs 26 and connect the breaker 30 to the receptacle 36. The receptacle 36 is beside the plurality of prongs 26 and parallel to the fourth side 24, and extends through the second side 20. The receptacle 36 has three holes 38 to function as a typical 110-volt female connector that receives a typical 110-volt male connector from a plug P of a device D.

In use, it can now be understood that the electrical adapter 10 steps down the voltage by half from a socket S to a receptacle 36. A person inserts the plurality of prongs 26 into the socket S. The person then checks the breaker 30 by pressing the button 32. The person then inserts a plug P of a device D into the receptacle 36. The person may then use the device D as desired. To test the breaker 30, to disable the electrical adapter 10, or to reset the breaker 30 after a fault, a person presses the button 32. To remove the electrical adapter 10, a person removes the plug P from the receptacle 36 then removes the electrical adapter 10 from the socket S.

While a preferred embodiment of the Electrical Adapter has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, any suitable sturdy material such as rubber, fiberglass, plastic, cardboard, or a variety of wood may be used instead of the poly-vinyl-chloride housing described. Also, the receptacle may have additional holes to attach multiple devices, particularly light construction tools. Although connecting residential appliances and tools to sockets of higher voltage have been described, it should be appreciated that the Electrical Adapter herein described is also suitable for connecting other 110-volt devices to a 220-volt socket.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An electrical adapter to connect a plug of a device of a lower voltage to a socket of an higher voltage, comprising:

a housing having a front face, a rear face opposite said front face, a first side substantially perpendicular to said front face and joining said front face to said rear face, a second side opposite said first side and joining said front face and said rear face, a third side substantially perpendicular to said first side and joining said front face and said rear face, and a fourth side opposite said third side and joining said front face and said rear face;

a plurality of prongs extending outward and away from said front face in registration with said socket, including a first prong of round cross-section in a plane parallel to said front face;

a breaker positioned between said front face and said rear face substantially near and parallel to said third side including a button that extends through said second side;

a first plurality of wires connecting each of said prongs individually to said breaker;

at least one receptacle positioned between said front face and said rear face substantially near and parallel to said fourth side and extending through said second side partially along the length of said receptacle, with holes that receive said plug of said device; and, a second plurality of wires connecting each of said holes individually to said breaker, having one less hot wire than said first plurality of wires thereby lowering the voltage at said receptacle.

2. The electrical adapter of claim 1 wherein said front face is concave of width between said third side and said fourth side, of maximum depth at the center of said front face, and of length from said first side to said second side.

3. The electrical adapter of claim 1 wherein said housing is made of an electrically inert material.

4. The electrical adapter of claim 1 wherein said housing is made of poly-vinyl-chloride plastic.

5. The electrical adapter of claim 1 wherein said prongs, except said first prong, have a rectangular cross section in a plane parallel to said front face.

6. The electrical adapter of claim 1 wherein said breaker is installed serially with said hot wire connected to both said socket and said receptacle.

7. The breaker of claim 6 wherein said breaker has a rating of one or more amperes.

8. The electrical adapter of claim 1 wherein said receptacle is polarized.

9. The electrical adapter of claim 1 wherein said device is selected from the group consisting of a residential stove with oven, a residential dryer, and an electrically powered tool.

* * * * *